US006141851A

United States Patent [19]

Reinbold, Jr.

[11] Patent Number: 6,141,851

[45] Date of Patent: Nov. 7, 2000

[54] APPARATUS FOR FORMING A HARDBOARD PICTURE PUZZLE INCLUDING MULTIPLE PUZZLE PIECES

[75] Inventor: Frederick I. Reinbold, Jr., Grand Prairie, Tex.

[73] Assignee: Williamson Printing Corporation, Dallas, Tex.

[21] Appl. No.: 09/002,322

[22] Filed: Jan. 2, 1998

[51] Int. Cl.[7] ..... B23P 17/00

[52] U.S. Cl. ..... 29/412; 29/416

[58] Field of Search ..... 29/415, 416, 412; 83/50, 55; 144/3.1, 367; 428/33

[56] References Cited

U.S. PATENT DOCUMENTS 3,715,795 2/1973 Greenberg et al. ..... 29/412
3,964,750 6/1976 Brown ..... 273/157 R

FOREIGN PATENT DOCUMENTS

4325480 A1 2/1995 Germany ..... 428/33

*Primary Examiner*—I Cuda
*Attorney, Agent, or Firm*—Jones, Day, Reavis & Pogue

[57] ABSTRACT

A method and apparatus for forming a hardboard picture puzzle having multiple puzzle pieces without the use of a "start hole" and with the use of a die for cutting the picture puzzle about its perimeter and using a band saw to cut individual pieces forming said picture puzzle.

4 Claims, 3 Drawing Sheets

APPARATUS FOR FORMING A HARDBOARD PICTURE PUZZLE INCLUDING MULTIPLE PUZZLE PIECES

BACKGROUND OF THE INVENTION

1. Field of the Invention

The present invention relates to a method and apparatus for forming a hardboard picture puzzle including multiple puzzle pieces within a recess in a hardboard frame having a front and a back.

2. Description of Related Art Including Information Disclosed Under 37 CFR 1.97 and 1.98

Hardboard picture puzzles are in wide demand. Hardboard is defined herein as particle board (such as Masonite™) or other hardboard products having regionally specific brand names such as "Euroboard". Since these types of puzzles are commonly referred to as "wooden" puzzles, they will be referred to herein as "wood board" puzzles. They include a frame on a backboard with a recess in the frame forming a perimeter of the picture puzzle. The picture puzzle is cut into numerous puzzle pieces that are then placed back in the frame recess from which they were taken originally. These puzzles are made by taking the frame portion, attaching the puzzle picture to the frame, drilling a hole in the outer perimeter of the area where the picture puzzle is to be formed, and then taking a jigsaw and cutting out the puzzle pieces as well as the perimeter of the puzzle in a continuous process. A backboard is then attached to the back of the frame and the unit is packaged and sold.

This construction has several disadvantages. First, a jigsaw or scroll saw is used that reciprocates and does not leave as smooth a cut as, for instance, a band saw. Additionally, a "start hole" must be drilled in the puzzle at the perimeter to allow the jigsaw blade to be inserted. Third, when the outer edges of the hardboard frame of the puzzle are trimmed, the saw blade leaves particles of sawdust that, at times becomes packaged along with the puzzle.

In addition, the jigsaw or scroll saw removes a significant portion of the hardboard as it cuts the individual puzzle pieces and the perimeter forming the recess in which the puzzle pieces rest. After it is thus cut, because of the material removed between the puzzle pieces as well as along the perimeter, there is usually a great deal of extra space within the recess in which the puzzle pieces are placed. They do not fit snugly or close together within the recess.

It would be advantageous to have a wood board puzzle that is formed without a "start hole", that has puzzle pieces that fit more closely together within the recess, and that did not have sawdust residue that is packaged with the puzzle.

SUMMARY OF THE INVENTION

In the present invention, the perimeter of the picture puzzle is die cut in the hardboard frame to form a picture portion that is removed from the frame leaving a recess in the frame. A backboard is then attached to the frame back as, for example, by glueing and the picture portion that has been removed is cut into multiple puzzle pieces. The cut multiple puzzle pieces are then inserted into the recess to form the wood board puzzle.

The advantages of this method of forming a wood board puzzle are several. First, there is no "start hole". Thus the puzzle has a more pleasing appearance without any of the puzzle picture missing as is the case with a "start hole" formed therein. Secondly, by die cutting the perimeter of the picture puzzle and then using a band saw to form the individual puzzle pieces, two advantages are obtained. First, because of the die cutting of the perimeter of the picture puzzle, no wood is removed as is the case where a saw is used due to the kerf of the saw blade and the removed picture portion has a tendency to fit closely with the edges of the recess. Thus, when the picture puzzle is cut into its individual puzzle pieces, the puzzle pieces fit more snugly together because no wood is removed along the outer perimeter where the die cutting takes place. Secondly, there is a smoother cut formed by the band saw than can be formed by the jigsaw or scroll saw thereby enabling the puzzle pieces to fit together more precisely. Finally, if the outer edges of the puzzle frame are trimmed with a punch press or a die, sawdust, that could possibly be left on the puzzle and included in the packaged puzzle, is eliminated.

Thus, it is an important object of the present invention to provide a wood board picture puzzle that has the puzzle perimeter die cut from the frame thereby eliminating the necessity of a "start hole" for a jigsaw or scroll saw.

It is another object of the present invention to provide a wood board picture puzzle in which the puzzle pieces within the recess fit more closely together by using a die to cut the picture puzzle from the frame.

It is still another object of the present invention to form the multiple picture puzzle pieces with the use of a band saw thus providing a smoother surface that can be formed with a scroll saw or jigsaw which must be used when there is a "start hole".

It is also another object of the present invention to provide a wood board picture puzzle whose outer frame edges are trimmed by a punch press or a die thereby eliminating the production of sawdust and maintaining the finished board in a cleaner state for packaging.

Thus the present invention relates to a method of forming a wood board picture puzzle including multiple puzzle pieces within a recess in a wood board frame having a front and a back, the method comprising the steps of die cutting the perimeter of the picture puzzle in the frame, removing the die cut picture puzzle from the frame along its perimeter, attaching a backboard to the frame back to form a recess, cutting the removed picture puzzle into its multiple puzzle pieces, and inserting the cut puzzle pieces into the same frame recess from which they were taken to form the wood board puzzle.

The method also relates to the use of a band saw to cut the picture puzzle into its multiple puzzle pieces.

The invention also relates to apparatus for forming the wood board picture puzzle with multiple puzzle pieces within the perimeter of a recess in a wood board frame attached to a backboard, the wood frame having a front and a back side and the apparatus comprising a die for cutting the perimeter of the picture puzzle for removal from the frame, a glue device for applying glue on the back of the frame to enable the frame to be attached to the backboard to form the recess from which the picture puzzle was removed, and a band saw for cutting the multiple puzzle pieces from the removed picture puzzle for placement in the same recess from which they were removed to form the wood board picture puzzle.

BRIEF DESCRIPTION OF THE DRAWINGS

These and other features of the present invention will be more fully disclosed when taken in conjunction with the following DETAILED DESCRIPTION OF THE PREFERRED EMBODIMENT(S) in which like numerals represent like elements and in which.

DETAILED DESCRIPTION OF THE PREFERRED EMBODIMENT(S)

Figure 1:
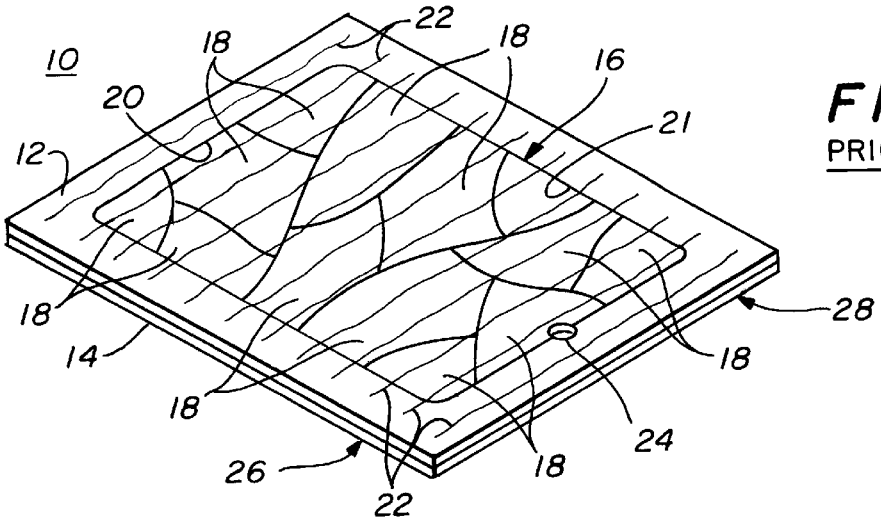
FIG. 1 PRIOR ART
FIG. 1 is a schematic representation of a wood board picture puzzle of the prior art.

FIG. 1 illustrates a prior art wood board puzzle 10. It includes a frame 12 attached in any well-known manner to a backboard 14. The puzzle 16 is formed with a plurality of pieces 18 within a recess having a perimeter 20. A picture that illustrates the type of puzzle constructed is placed over the frame 12 and puzzle 16 as illustrated by the lines 22.

In order to form the puzzle, the frame 12 has a "start hole" 24 drilled therein and a jigsaw or scroll saw blade is inserted through the start hole 24 and cuts are made along the perimeter 20 and each individual puzzle piece 18 is also cut out in one operation. The backboard 14 is then attached to the backside of the frame 12. The puzzle pieces 18 can then be removed from the recess perimeter 20 and the puzzle reconstructed by the user.

This construction requires, first, the "start hole" 24 being drilled in the perimeter 20 of the picture puzzle 16 in frame 12. The "start hole" thus tends to mar the puzzle picture and is not aesthetically pleasing. The scroll saw or jigsaw has an oscillating saw blade which leaves rather comparatively wide cuts in the frame 12 as the perimeter 20 and the individual puzzle pieces 18 are being cut. Therefore, when the puzzle pieces are reinserted in the recess formed by perimeter 20, there is a good deal of motion or play between pieces because of the large amount of the frame material that has been removed during cutting. Secondly, of course, as stated previously, the "start hole" 24 remains in the board and presents a rather unattractive appearance.

Further, when the outer edges 26 and 28 are finally trimmed, they are trimmed with a saw, such as a scroll saw that leaves sawdust residue on the puzzle 10 and the sawdust may be encompassed within the package formed when the wood board picture puzzle 10 is wrapped in any well-known manner for retail merchandising.

Figure 2:
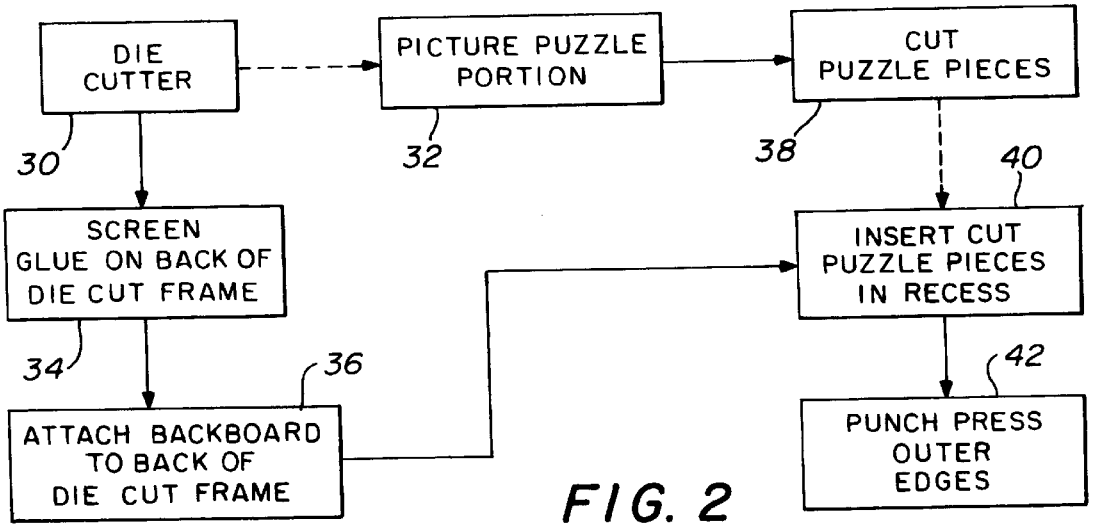
FIG. 2 is a block diagram schematic representation of the apparatus used to form the wood board puzzle.
Figure 3A:
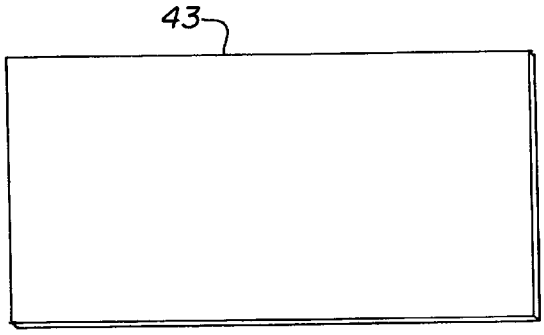
FIGS. 3(*a*)–(*l*) illustrate the steps of the process of the present invention for forming a wood board puzzle.
Figure 3B:
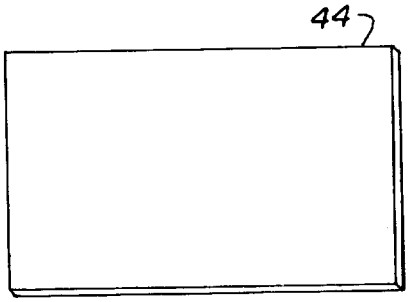
Figure 3C:
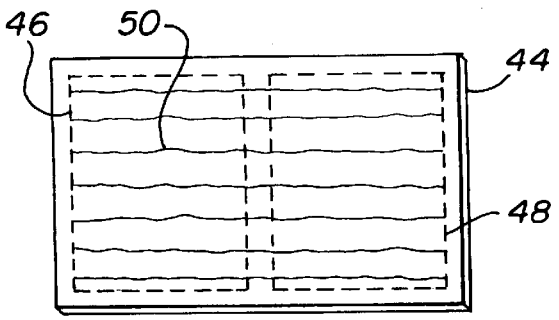
Figure 3D:
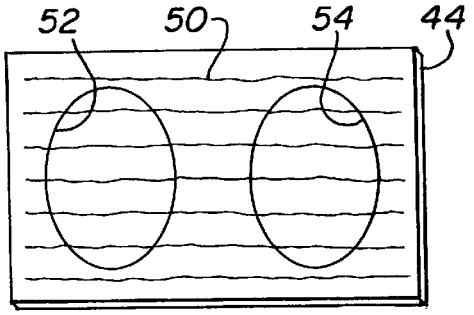
Figure 3E:
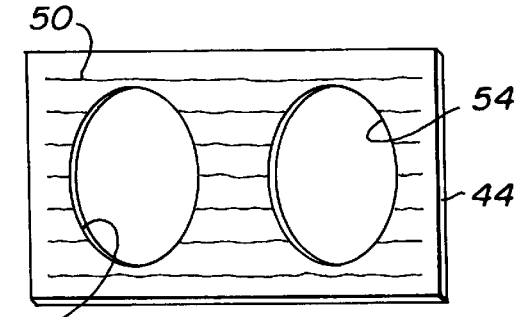
Figure 3F:
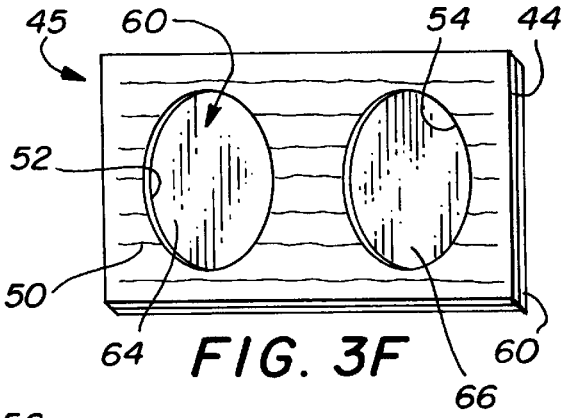
Figure 3G:
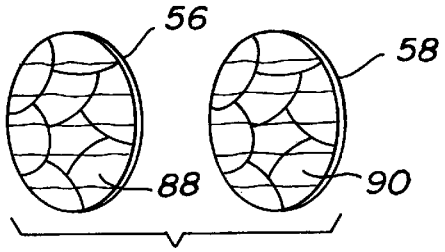
Figure 3H:
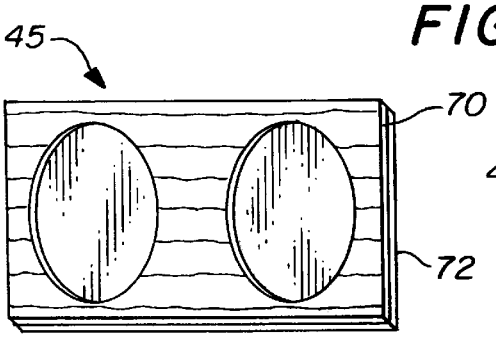
Figure 3I:
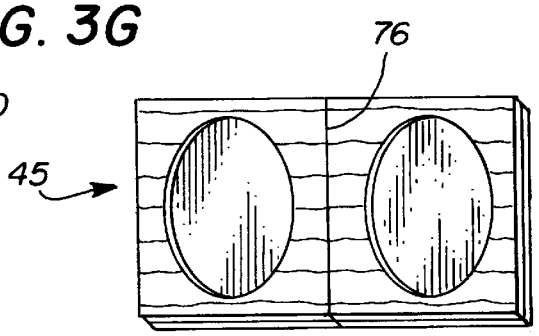
Figure 3J:
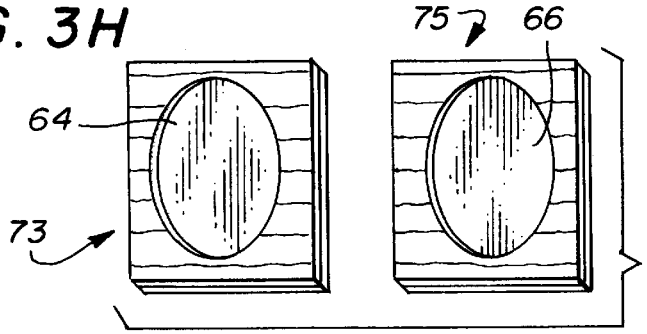
Figure 3K:
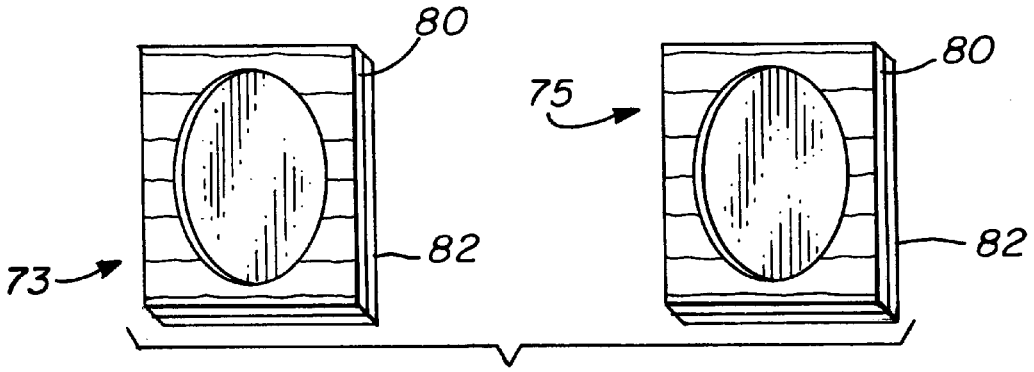
Figure 3L:
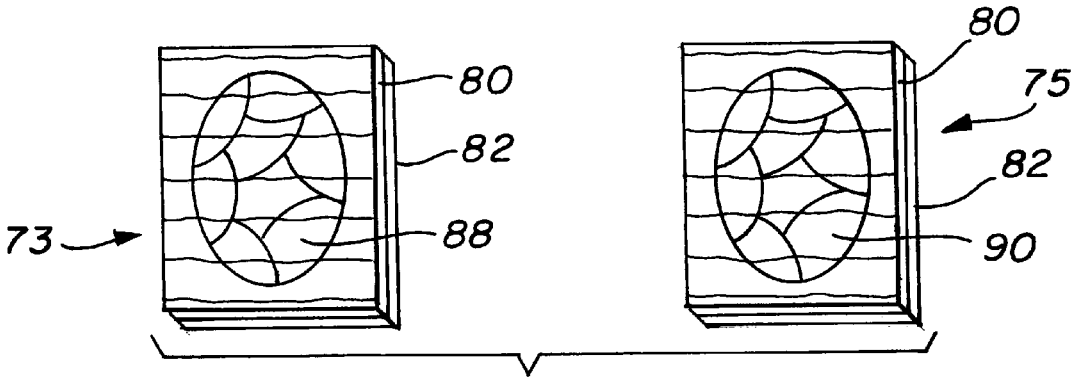

FIG. 2 is a schematic representation of the apparatus of the present invention for providing an improved wood board picture puzzle. The die cut cutter 30 is first used to cut the perimeter of the picture puzzle in the frame 12 along perimeter lines 20 without the requirement of a "start hole". The die cut picture puzzle 32 is then removed from the frame 12 in any well-known manner and a glue machine 34 applies glue to the back of the die cut frame 12 and the frame is then transferred to the station 36 where the backboard 14 is attached to the frame 12 in any well-known manner to form a recess having the perimeter 20 shown in FIG. 1.

Simultaneously, if desired, band saw 38 cuts the picture puzzle 32 into the desired pieces 18 as shown in FIG. 1. The pieces 18 are then inserted into the recess formed by perimeter 20 in any well-known manner at machine 40. Of course, the pieces can be placed in the recess by hand if desired.

With this apparatus, the die cutter 30 eliminates the need for the start hole 24 and allows the puzzle pieces 18 to fit more closely together because no wood is removed along the outer edge 21 of the picture puzzle 16 as a result of the die cutting as is well known. This die cutting process compensates for the space created between the pieces 18 by the band saw removing material as it cuts. In addition, the band saw 38 forms a smoother cut to separate the pieces 18 from each other, thus enabling a better fit simply because of the smoothness of the cut of the individual pieces 18 and the die cutting operation.

The assembled board 10 is then sent to punch press or table circular saw 42 which trims the outer edges 26 and 28 to form a finished puzzle 10. The use of a punch press 42 is preferred because it eliminates the sawdust residue formed when a band saw is used.

Thus the novel apparatus of the present invention provides a wood board picture puzzle that has a number of advantages. First among these advantages is the elimination of the "start hole". Secondly, the die cutting of the outer perimeter of the picture puzzle enables the individual pieces to fit more closely within a recess formed by the die cutting because the die cutting process does not remove wood. Thirdly, after the picture puzzle has been die cut and removed from the frame, it can be cut with a band saw which has a much smoother cut than a jigsaw or scroll saw that is used with the "start hole" method thus enabling the puzzle pieces to have a better "fit" with one another. Finally, the use of a punch press or die to trim the outer edges of the wood board picture puzzle eliminates the generation of any sawdust which may leave a residue on the puzzle that might be packaged.

FIGS. 3(*a*)–3(*l*) illustrate the process steps of the present invention.

In step 1 shown in FIG. 3(*a*) a sheet of wood board 43 is provided of any desired size. For example only, it may be eight feet by four feet by a thickness suitable for wood board puzzles. This wood board must be of a type that can be die cut. Not all wood board can be die cut. However, any wood board that can be die cut could be used. A preferred hardboard is imported to the U.S. by Holland International Corp. and is a Baltic hardboard sold commercially under the designation "Euroboard".

Also in step 1 shown in FIG. 3(*b*), the wood board 43 is cut to a desired size 44 such as, for example only, 19 inches by 11⅞ inches, which is a size that would allow two wood board picture puzzles to be formed thereon.

In step 2 shown in FIG. 3(*c*), the front of the wood board has two picture puzzle faces attached thereto by screening glue on the front of the wood board, thus giving a pictorial illustration of the puzzle to be formed. In this particular case, two wood board picture puzzles 46 and 48 having indicia 50 may be formed on one wood board frame 44 as shown.

At step 3 shown in FIG. 3(*d*), the die cutting machine is used to form the outer perimeters 52 and 54 of two picture puzzle centers on the one sheet of wood board 44.

At step 4 shown in FIG. 3(*e*), the picture puzzle centers 56 and 58 are removed from the wood board to be used later as illustrated in FIG. 3(*g*).

At step 5 shown in FIG. 3(*f*), a backboard 60 is attached to the back side of the frame 44 thus forming a puzzle board 45 with recesses 64 and 66.

At step 6 as shown in FIG. 3(*h*), the upper edge 70 and the lower edge 72 of the puzzle board 45 are trimmed with a table saw.

At step 7 as shown in FIG. 3(*i*), the puzzle board 45 is cut with a table saw at 76 to separate the two puzzles 73 and 75 shown in FIG. 3(*j*) that have been formed on the common board.

In step 8, as shown in FIG. 3(*k*), the outer edges 80 and 82 of each of the picture wood boards are trimmed as with a table saw.

FIG. 3(*g*) represents the picture puzzle portions 56 and 58 that were removed from the frame at step 4 as shown in FIG. 3(*e*). At step 5A shown in FIG. 3(*g*), the two picture puzzles 56 and 58 are cut with a band saw into the individual puzzle pieces 88 and 90.

At step 9 shown in FIG. 3(*l*), the cut pieces 88 and 90 of the puzzles 56 and 58 are inserted in the recesses of their respective puzzle frames 73 and 75.

Figure 4:
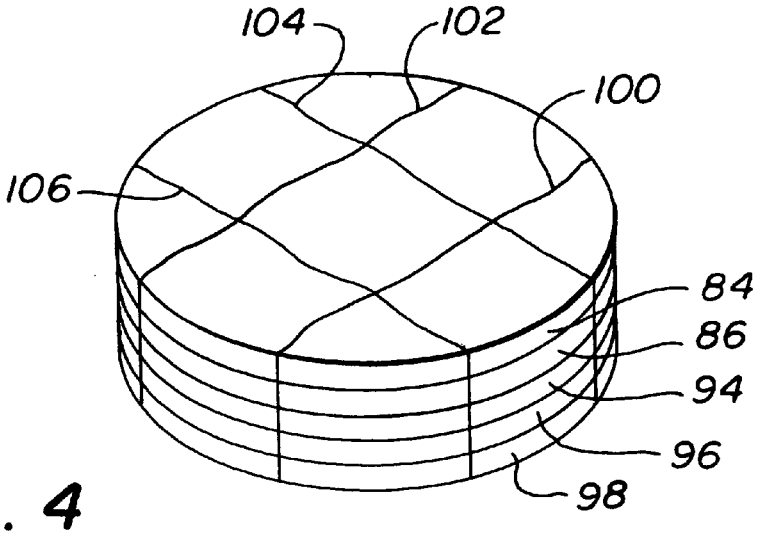
FIG. 4 is a diagrammatic representation of a plurality of die cut picture puzzles stacked together for simultaneous cutting of a plurality of puzzle pieces having a common pattern for each of the picture puzzles.

As shown in FIG. 4, if desired, multiple picture portions 84, 86, 94, 96, and 98, each die cut from an individual frame, may be stacked and cut simultaneously along lines 100, 102, 104, and 106. However, in such case, puzzle 84 must be placed back in the same frame from which it was taken, 86 must be placed in the same frame from which it was taken, and so forth. Thus, each of the particular puzzles formed of multiple pieces have to be placed in the frame from which that puzzle was originally taken.

Thus there has been disclosed a novel method and apparatus for forming a wood board picture puzzle which does not require the use of a "start hole", uses a die cut to form the perimeter of each puzzle, utilizes a band saw to cut the picture puzzles into their individual pieces, and which may use a punch press or a die to trim the outer edges thereof to avoid generation of sawdust in the final stage of construction of the puzzle. Of course, if desired, a table saw may be used but care must be taken to remove any sawdust from the puzzle before packaging.

The corresponding structures, materials, acts, and equivalents of all means or step plus function elements in the claims below are intended to include any structure, material, or act for performing the function in combination with other claimed elements as specifically claimed.

I claim:

1. A method of forming a wood board picture puzzle, comprising the steps of:

providing a wood board having a first surface separated from a second surface by a thickness, with a picture on said first surface;

die cutting said wood board completely around said picture and completely through said thickness from said first surface to said second surface, thereby providing a die cut portion having said picture thereon and a frame defining an opening and surrounding the die cut portion;

removing said die cut portion from said opening;

attaching a back board to one side of said frame, thereby closing said opening from said one side;

with said die cut portion removed from said opening, using a band saw such that said die cut portion is cut into multiple puzzle pieces; then inserting said multiple puzzle pieces into said opening from a side of said frame that is opposite said one side, whereby said multiple puzzle pieces are prevented by said back board from exiting said opening from said one side; and using a punch press such that a peripheral portion of said frame is removed and said frame attains its final configuration.

2. The method of claim 1 wherein:

the providing step includes providing a plurality of wood boards each having a first surface separated from a second surface by a thickness, with a picture on said first surface;

the die cutting step includes die cutting each of said plurality of wood boards completely around said picture and completely through said thickness from said first surface to said second surface, thereby providing a plurality of die cut portions having said picture thereon and a frame defining an opening and surrounding the die cut portions;

the removing step includes removing said die cut portion from said opening of each of said plurality of die cut wood boards;

the attaching step includes attaching a back board to one side of each one of said frames, thereby closing said opening from said one side of each one of said frames;

with each die cut portion removed from its respective opening, the using a band saw step includes stacking said plurality of die cut portions and using a band saw such that each of said stacked die cut portions are simultaneously cut into identical multiple puzzle pieces;

the inserting step includes inserting said multiple puzzle pieces into each of their respective said openings from a side of said frame that is opposite said one side, whereby said multiple puzzle pieces are prevented by said back board from exiting said opening from said one side; and the using a punch press step includes using a punch press such that a peripheral portion of each of plurality of said frames is removed and said frames attain their final configuration.

3. The method of claim 1 wherein the step of attaching a backboard to the one side of the wood board frame further comprises the steps of:

applying glue on said one side of said frame; and then placing said one side of said wood board frame onto said backboard, thereby gluing said wood board frame to said backboard.

4. The method of claim 1 further comprising the steps of:

screening glue on the front of said wood board frame; and attaching a puzzle picture to the front of said wood board frame with said glue prior to the die cutting step.

* * * * *